US010676875B1

(12) United States Patent
Robinson

(10) Patent No.: US 10,676,875 B1
(45) Date of Patent: Jun. 9, 2020

(54) EXPANSION JOINT SEAL SYSTEM FOR DEPTH CONTROL

(71) Applicant: Schul International Co., LLC, Hudson, NH (US)

(72) Inventor: Steven R. Robinson, Windham, NH (US)

(73) Assignee: Schul International Co., LLC, Hudson, NH (US)

( * ) Notice: Subject to any disclaimer, the term of this patent is extended or adjusted under 35 U.S.C. 154(b) by 0 days.

(21) Appl. No.: 16/240,424

(22) Filed: Jan. 4, 2019

(51) Int. Cl.
*E01C 11/00* (2006.01)
*E01C 11/10* (2006.01)

(52) U.S. Cl.
CPC ..... *E01C 11/10* (2013.01)

(58) Field of Classification Search
CPC ..... E01C 11/10
USPC ..... 404/46–69
See application file for complete search history.

(56) References Cited

U.S. PATENT DOCUMENTS 1,033,431 A * 7/1912 McCarthy ..... E01C 11/126 404/47
1,427,557 A * 8/1922 Smith ..... E01C 11/123 404/54
1,427,558 A * 8/1922 Smith ..... E01C 11/123 404/54
1,566,319 A * 12/1925 Fischer ..... E01C 11/123 404/74
1,697,563 A * 1/1929 Heltzel ..... E01C 11/04 404/49
2,100,238 A * 11/1937 Burgess ..... E04B 1/6803 52/393
2,122,167 A * 6/1938 Wittenberg ..... E01C 11/106 404/49
3,323,426 A * 6/1967 Hahn ..... E01C 11/106 404/48
3,410,184 A * 11/1968 Hamel ..... E01C 11/126 404/49
3,461,781 A * 8/1969 Weiner ..... E04B 1/6812 404/48
4,290,249 A * 9/1981 Mass ..... E01D 19/06 404/65
5,607,253 A * 3/1997 Almstrom ..... E01D 19/067 404/47
6,751,919 B2 * 6/2004 Calixto ..... E04B 1/6815 404/49
8,317,444 B1 11/2012 Hensley
8,341,908 B1 1/2013 Hensley et al.
8,365,495 B1 2/2013 Witherspoon
8,739,495 B1 6/2014 Witherspoon
8,813,449 B1 8/2014 Hensley et al.
8,813,450 B1 8/2014 Hensley et al.
8,870,506 B2 10/2014 Hensley et al.
9,068,297 B2 6/2015 Hensley et al.
9,200,437 B1 12/2015 Hensley et al.
9,206,596 B1 12/2015 Robinson
9,322,163 B1 4/2016 Hensley
9,404,581 B1 8/2016 Robinson
9,528,262 B2 12/2016 Witherspoon
9,631,362 B2 4/2017 Hensley et al.
9,637,915 B1 5/2017 Hensley et al.
(Continued)

*Primary Examiner* — Raymond W Addie
(74) *Attorney, Agent, or Firm* — Crain, Caton & James, P.C.; James E. Hudson, III

(57) ABSTRACT

An expansion joint seal system for supporting an expansion joint seal. The system includes an installation member and a base member.

13 Claims, 4 Drawing Sheets

(56) References Cited

U.S. PATENT DOCUMENTS

| | | | |
|---|---|---|---|
| 9,644,368 | B1 | 5/2017 | Witherspoon |
| 9,670,666 | B1 | 6/2017 | Witherspoon et al. |
| 9,689,157 | B1 | 6/2017 | Hensley et al. |
| 9,689,158 | B1 | 6/2017 | Hensley et al. |
| 9,739,049 | B1 | 8/2017 | Robinson |
| 9,739,050 | B1 | 8/2017 | Hensley et al. |
| 9,745,738 | B2 | 8/2017 | Robinson |
| 9,765,486 | B1 | 9/2017 | Robinson |
| 9,803,357 | B1 | 10/2017 | Robinson |
| 9,840,814 | B2 | 12/2017 | Robinson |
| 9,850,662 | B2 | 12/2017 | Hensley |
| 9,856,641 | B2 | 1/2018 | Robinson |
| 9,951,515 | B2 | 4/2018 | Robinson |
| 9,963,872 | B2 | 5/2018 | Hensley et al. |
| 9,982,428 | B2 | 5/2018 | Robinson |
| 9,982,429 | B2 | 5/2018 | Robinson |
| 9,995,036 | B1 | 6/2018 | Robinson |
| 10,000,921 | B1 | 6/2018 | Robinson |
| 10,060,122 | B2 | 8/2018 | Robinson |
| 10,066,386 | B2 | 9/2018 | Robinson |
| 10,066,387 | B2 | 9/2018 | Hensley et al. |
| 10,081,939 | B1 | 9/2018 | Robinson |
| 10,087,619 | B1 | 10/2018 | Robinson |
| 10,087,620 | B1 | 10/2018 | Robinson |
| 10,087,621 | B1 | 10/2018 | Robinson |
| 10,072,413 | B2 | 11/2018 | Hensley et al. |
| 10,125,490 | B2 | 11/2018 | Robinson |
| 10,179,993 | B2 | 1/2019 | Hensley et al. |
| 10,203,035 | B1 | 2/2019 | Robinson |
| 10,213,962 | B2 | 2/2019 | Robinson |
| 10,227,734 | B1 | 3/2019 | Robinson |
| 10,233,633 | B2 | 3/2019 | Robinson |
| 2014/0219719 | A1 | 8/2014 | Hensley et al. |
| 2014/0360118 | A1 | 12/2014 | Hensley et al. |
| 2015/0068139 | A1 | 3/2015 | Witherspoon |
| 2017/0130450 | A1 | 5/2017 | Witherspoon |
| 2017/0159817 | A1 | 6/2017 | Robinson |
| 2017/0191256 | A1 | 7/2017 | Robinson |
| 2017/0226733 | A1 | 8/2017 | Hensley et al. |
| 2017/0241132 | A1 | 8/2017 | Witherspoon |
| 2017/0254027 | A1 | 9/2017 | Robinson |
| 2017/0268222 | A1 | 9/2017 | Witherspoon et al. |
| 2017/0292262 | A1 | 10/2017 | Hensley et al. |
| 2017/0298618 | A1 | 10/2017 | Hensley et al. |
| 2017/0314213 | A1 | 11/2017 | Robinson |
| 2017/0314258 | A1 | 11/2017 | Robinson |
| 2017/0342665 | A1 | 11/2017 | Robinson |
| 2017/0342708 | A1 | 11/2017 | Hensley et al. |
| 2017/0370094 | A1 | 12/2017 | Robinson |
| 2018/0002868 | A1 | 1/2018 | Robinson |
| 2018/0016784 | A1 | 1/2018 | Hensley et al. |
| 2018/0038095 | A1 | 2/2018 | Robinson |
| 2018/0106001 | A1 | 4/2018 | Robinison |
| 2018/0106032 | A1 | 4/2018 | Robinison |
| 2018/0119366 | A1 | 5/2018 | Robinison |
| 2018/0142465 | A1 | 5/2018 | Robinison |
| 2018/0148922 | A1 | 5/2018 | Robinison |
| 2018/0163394 | A1 | 6/2018 | Robinison |
| 2018/0171564 | A1 | 6/2018 | Robinison |
| 2018/0171625 | A1 | 6/2018 | Robinison |
| 2018/0202148 | A1 | 7/2018 | Hensley et al. |
| 2018/0238048 | A1 | 8/2018 | Robinison |
| 2018/0266103 | A1 | 9/2018 | Robinson |
| 2018/0274228 | A1 | 9/2018 | Robinson |
| 2018/0300490 | A1 | 10/2018 | Robinson |
| 2018/0363292 | A1 | 12/2018 | Robinson |
| 2018/0371746 | A1 | 12/2018 | Hensley et al. |
| 2018/0371747 | A1 | 12/2018 | Hensley et al. |
| 2019/0057215 | A1 | 2/2019 | Robinson |
| 2019/0063608 | A1 | 2/2019 | Robinson et al. |
| 2019/0071824 | A1 | 3/2019 | Robinson |

* cited by examiner

EXPANSION JOINT SEAL SYSTEM FOR DEPTH CONTROL

CROSS-REFERENCE TO RELATED APPLICATIONS

None.

STATEMENT REGARDING FEDERALLY SPONSORED RESEARCH OR DEVELOPMENT

Not Applicable.

BACKGROUND

Field

The present disclosure relates generally to a system for controlling the depth of installation of a durable seal between adjacent panels, including those which may be subject to temperature expansion and contraction or mechanical shear. More particularly, the present disclosure is directed to an expansion joint seal system for controlling depth and enabling replacement of installed expansion joint seals.

Description of the Related Art

Construction panels come in many different sizes and shapes and may be used for various purposes, including roadways, sideways, and pre-cast structures, particularly buildings. Use of precast concrete panels for interior and exterior walls, ceilings and floors, for example, has become more prevalent. As precast panels are often aligned in generally abutting relationship, forming a lateral gap or joint between adjacent panels to allow for independent movement, such in response to ambient temperature variations within standard operating ranges, building settling or shrinkage and seismic activity. Moreover, these joints are subject to damage over time. Most damage is from vandalism, wear, environmental factors and when the joint movement is greater, the seal may become inflexible, fragile or experience adhesive or cohesive failure. As a result, "long lasting" in the industry refers to a joint likely to be usable for a period greater than the typical lifespan of five (5) years. Unfortunately, this short (compared to the lifespan of the associated structure) requires re-installation at the end of lifespan, or before, should the seal be damaged. Various seals have been created in the field.

Various seals have been developed for imposition between these panels to provide seals which provide one or more of fire protection, waterproofing, sound and air insulation. This typically is accomplished with a seal created by imposition of multiple constituents in the joint, such as silicone or elastomer application, backer bars, and compressible foams. One difficulty with these seals is ensuring and maintaining installation and function at the proper depth. Depth of seal and support provided during installation keeps the material from shifting while the expansion joint expands and while an adhesive, if used, cures. If the seal is recessed to far below the surface, it may accumulate debris or standing water. If the seal is insufficiently recessed, it may be damaged by surface contacts, such as pedestrian or vehicular traffic resulting in premature failure, that is, failure before the projected lifespan of the seal. When the expansion joint is uniformly or correctly oriented in relationship to the substrate it may provide for improved water resistance at the surface or deck level. Additionally, it is beneficial to have additional directional control or support for the expansion joint where it may be subject to transfer loads or dynamic movement or cycling such as in road and bridge joints. Bridge joints are often installed while partially open to traffic or quickly re-opened to traffic. Exposure to differential and other movement during installation or before the material has fully cured or expanded often results in the expansion joint materials shifting or moving out of the desired or optimal position. Substrates may vary in height from each other. It would be an improvement where the expansion joint can be installed and supported at an angle or taper from side to side between the substrates. It would be a further improvement if the support material is flexible or elastic to allow for multi-directional joint movement including transverse and longitudinal shear. Backer bars, for example, may be insufficiently driven into a gap between substrates, preventing the imposition of the necessary material, or may move during installation. Moreover, backer bars are problematic as the sealant material may surround and penetrate past the backer bar. In some instances, it is desirable to have a reliable method for setting and maintaining a variable or tapered depth of seal whether in the longitudinal orientation or transverse. It is further desirable for the hanger support and expansion joint to allow for or be installed in transitions and angular configurations.

These seals and transitions generally rely on compression to ensure a seal and may require mechanical or chemical attachment to substrate walls. Such products are therefore often sold in a precompressed state less than the nominal joint size, where release of the packaging on the site is followed by expansion of the seal, limiting the time for installation and therefore requiring an accurate joint placement which can be a problem. Similarly, the seal may be provided with one or more adhesive-coated sides with a release strip, which is removed to expose the adhesive. As the adhesive dries or becomes coated with other materials, its ability to bond to the substrate walls is reduced. Speed at installation is therefore often essential.

Unfortunately, these seals generally require installation according to visual observation of depth. Because of the flexibility of these systems, while one section of an expansion joint seal may be installed at the optimum depth, its adjacent sections may be too high or too low. When supplied in a pre-compressed format or after the adhesive is applied to the expansion joint, re-installation is problematic, if not impossible.

It would be an improvement to provide an expansion joint seal system which controls the installed depth and enables replacement of installed expansion joint seals.

SUMMARY

The present disclosure therefore meets the above needs and overcomes one or more deficiencies in the prior art by providing a system for controlling depth and enabling replacement or partial replacement of installed expansion joint seals.

The disclosure provides an expansion joint seal system comprising

Additional aspects, advantages, and embodiments of the disclosure will become apparent to those skilled in the art from the following description of the various embodiments and related drawings.

BRIEF DESCRIPTION OF THE DRAWINGS

So that the manner in which the described features, advantages, and objects of the disclosure, as well as others which will become apparent, are attained and can be understood in detail; more particular description of the disclosure briefly summarized above may be had by referring to the embodiments thereof that are illustrated in the drawings, which drawings form a part of this specification. It is to be noted, however, that the appended drawings illustrate only typical preferred embodiments of the disclosure and are therefore not to be considered limiting of its scope as the disclosure may admit to other equally effective embodiments.

In the drawings.

DETAILED DESCRIPTION

Figure 1:
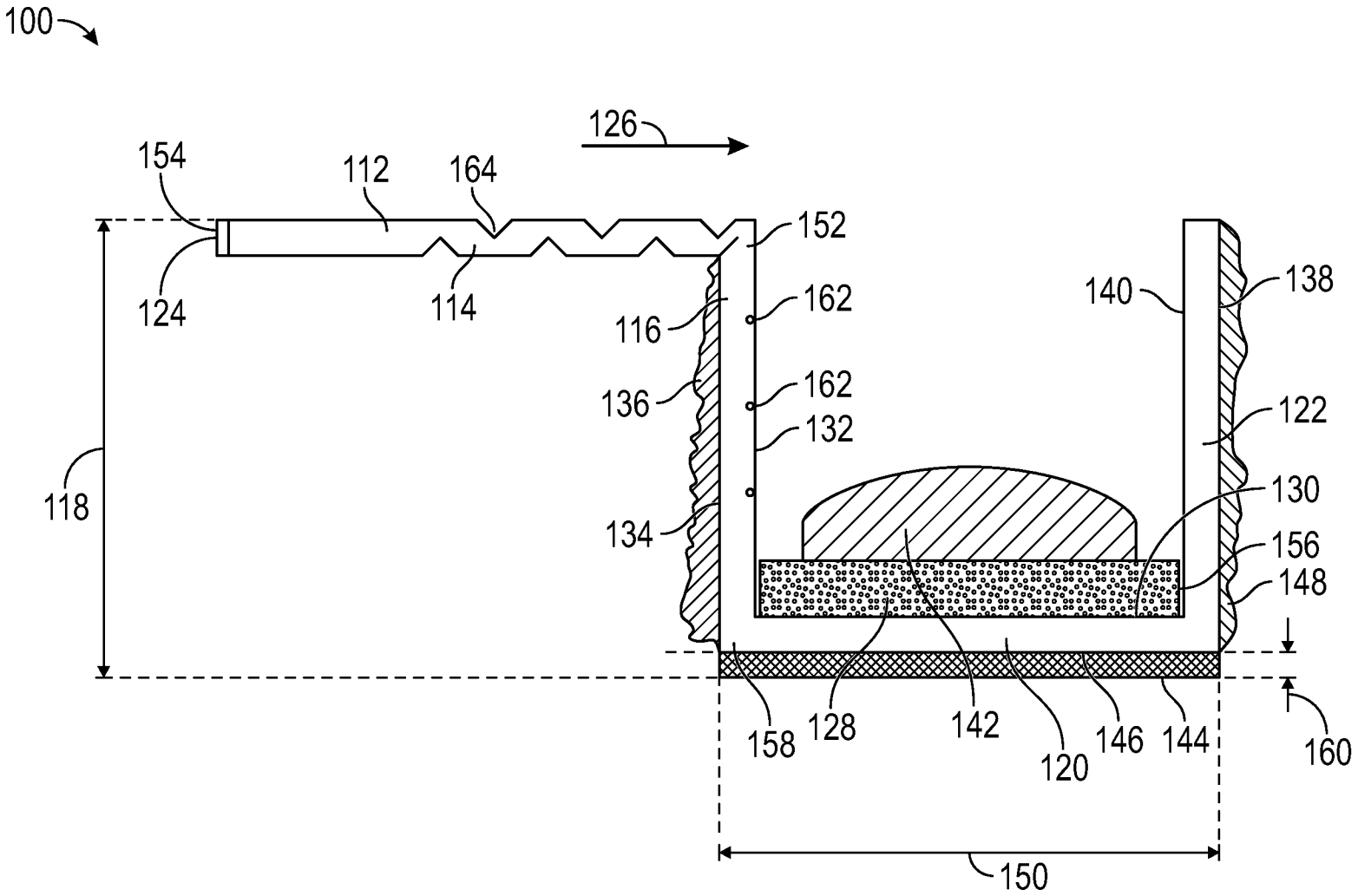
FIG. 1 provides an end view of one embodiment of the present disclosure.
Figure 2:
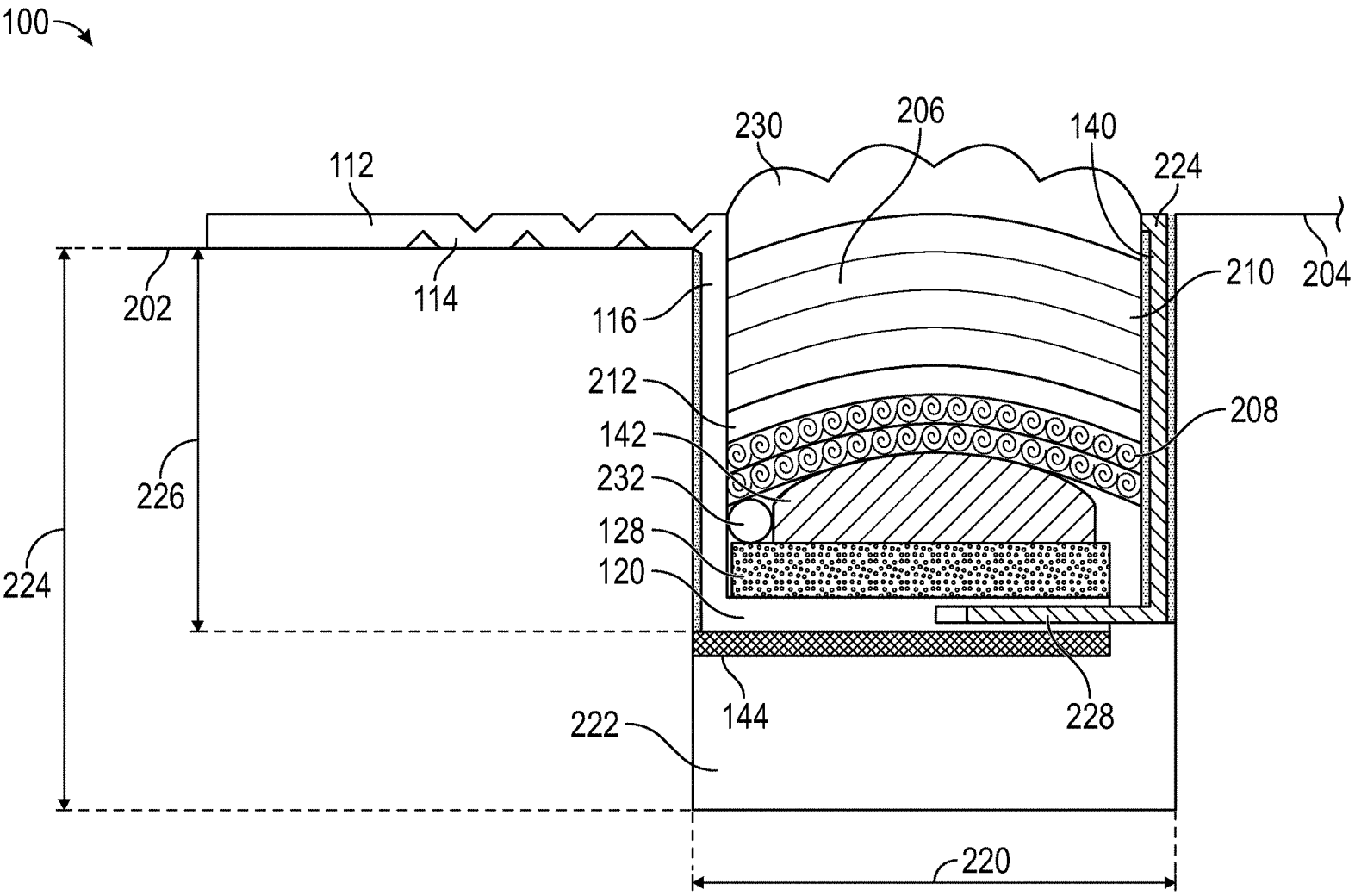
FIG. 2 provides a view of one embodiment of the present disclosure installed between two substrates.

Referring to FIGS. 1 and 2, end view of one embodiment of the expansion joint seal system 100 before at installation, respectively, is provided. The expansion joint seal system 100 is intended for imposition between a first substrate 202 and a second substrate 204. The expansion joint seal system 100 includes an installation member 112 and a base member 128. The installation member 112 is composed of a flexible and resilient material, which may be, for example, a polymer or plastic, metal, cellulose, a composite, or foam material. The material to be used is selected to ensure the installation member 112 will sustain the movement of the adjacent substrates 202, 204 without fatiguing or fracturing beyond its usable conditions for the intended lifespan, which may be the same as the installed expansion joint seal or may be greater. The installation member 112 may provide a reusable support for installation and reinstallation of expansion joint seals or may itself be removable to speed replacement. The installation member 112 may provide for partial repair or installation such as replacing the water retarding layer 210, which be a wear or primary seal, while retaining the other materials. It may be advantageous for the installation member 112 to be elastic whether under tension or not throughout the range of movement.

The installation member 112 is constructed to provide a hanger which includes a lip to remain above the top of an adjacent substrate 202, 204 and a ledge, which may be built up, or adjustable to support an expansion joint seal, whether of the time known now in the art or those which may be developed hereafter. The installation member 112 includes an installation member first horizontal element 114, an installation member first vertical element 116, having an installation member first vertical element height 118, and an installation member second horizontal element 120, which form the essential shape of the installation member 112. When desired, the installation member second horizontal element 120 may include one or more perforations therethrough to function as a drain or without to serve a secondary seal or moisture diverter. The installation member second horizontal element 120 may be rigid, semi-rigid, flexible or elastic. Installation member second horizontal element 120 may have a shape or profile preferably other than flat to allow for added expansion and contraction and/or a conduit or space to allow for retrofitting. Where the installation member second horizontal element 120 is elastic or flexible it may additionally provide for longitudinal or transverse shear. The installation member first horizontal element 114 provides the lip which fixes the installation member 112 in relation to the substrates 202, 204, particularly as to the depth of the installation member second horizontal element 120. The installation member first horizontal element 114 is fixed a particular distance, particularly an installation member first vertical element height 226, distant the installation member second horizontal element 120. The installation member first horizontal element 114 extends from the installation member first end 124 in a first direction 126. The installation member first horizontal element 114 is connected at an installation member first horizontal element second end 152 to the first vertical element 116 and has an installation member first end 124 at its opposing installation member first horizontal element first end 154. The installation member first horizontal element 114 is generally perpendicular, preferably 85-95 degrees though deviations of not more than +/−15 degrees may be acceptable, to the installation member first vertical element 116. The installation member first vertical element 116 has an installation member first vertical element exterior surface 134 and a first vertical element interior surface 132, where the installation member first vertical element exterior surface 134 is intermediate the first vertical element interior surface 132 and the installation member first end 124. The installation member second horizontal element 120 is also connected to the installation member first vertical element 116 so the two are generally perpendicular, preferably 85-95 degrees though deviations of not more than +/−15 degrees may be acceptable. The installation member second horizontal element 120 extends from the installation member first vertical element 116 in the first direction 126 and has a second horizontal element interior surface 130 and an installation member second horizontal element exterior surface 146. Because of its location between the substrates 202, 204, the installation member second horizontal element 120 may be horizontal or may be curved, such as concave or sinusoidally, to promote flexing while providing support. As a result, the installation member 112 presents a stepped profile for the installation member first horizontal element 114, the installation member first vertical element 116 and the installation member second horizontal element 120. The installation member first vertical element height 118 is sized to ensure the expansion joint seal system is fully retained within the gap 222 and is therefore not greater than the gap depth 108. Alternatively, where the substrate 202, 204, is insufficient or additional sealant or functional layers are desirable, the vertical element 116 may extend through and out of the joint or gap thereby providing an extension of the substrate necessary for the intended expansion joint function. If necessary, the thickness or materials may be adapted to provide functional support and function for the system. The installation member 112 may be covered by a substrate coating or installed into a notch or ledge in the substrate or may be set into a nosing or joint edge configuration.

The installation member 112 may include distance indicators 162 on the installation member first vertical member interior surface 132 which may indicate distance from the installation member first horizontal element interior surface 130, from the installation member first horizontal element second end 152, or the installation member first horizontal element first end 154. The installation member 112 may include notches on its surfaces to promote bending or folding of the installation member 112 to control its depth when installed, where a notch may be closed to promote an acute or right angle change in direction. While the installation member first horizontal element 114 may fit against the exposed surface of the substrate 202, 204 or may present an acute angle between the installation member first horizontal element 114 and the installation member first vertical element exterior surface 134, particularly where the installation member 112 has sufficient rigidity to provide a spring force which may be used during installation to force the expansion joint seal system 100 into position. As can be appreciated, the installation member 112 provides a less than normal depth-to-width ratio.

Figure 3:
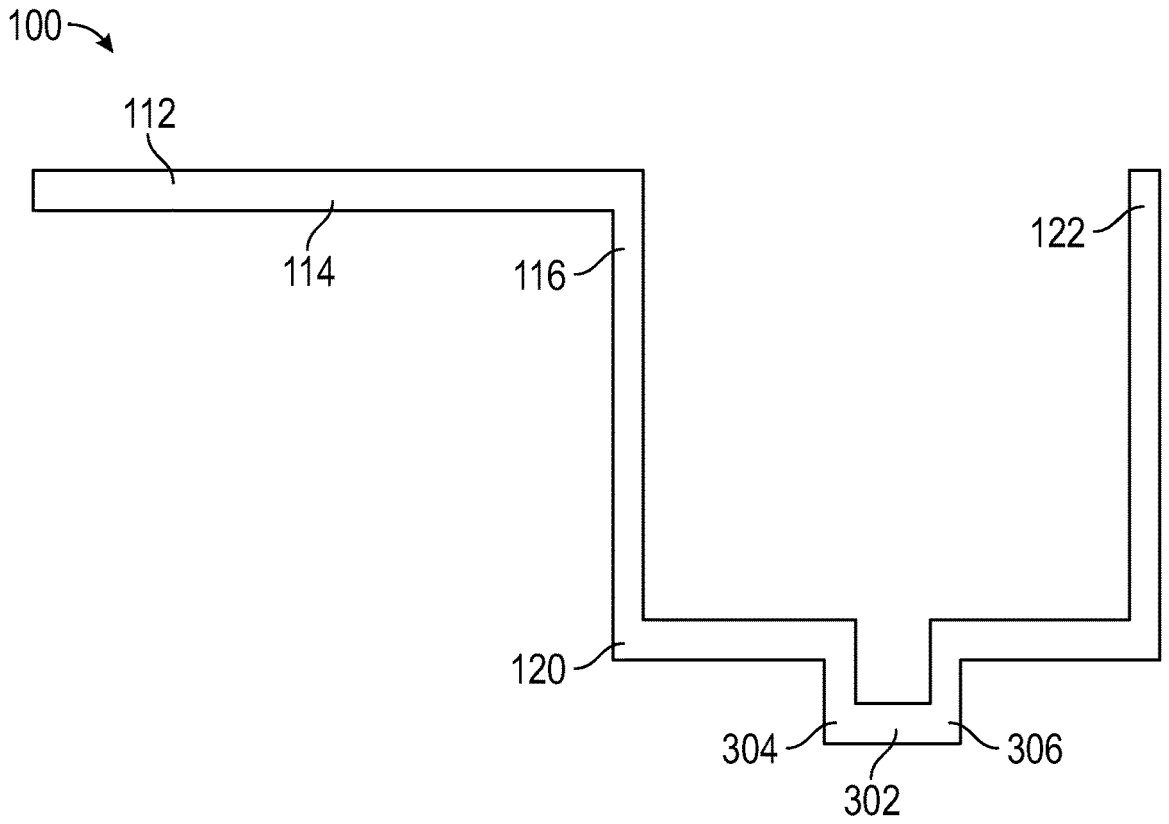
FIG. 3 provides an alternative structure of the installation member.
Figure 4:
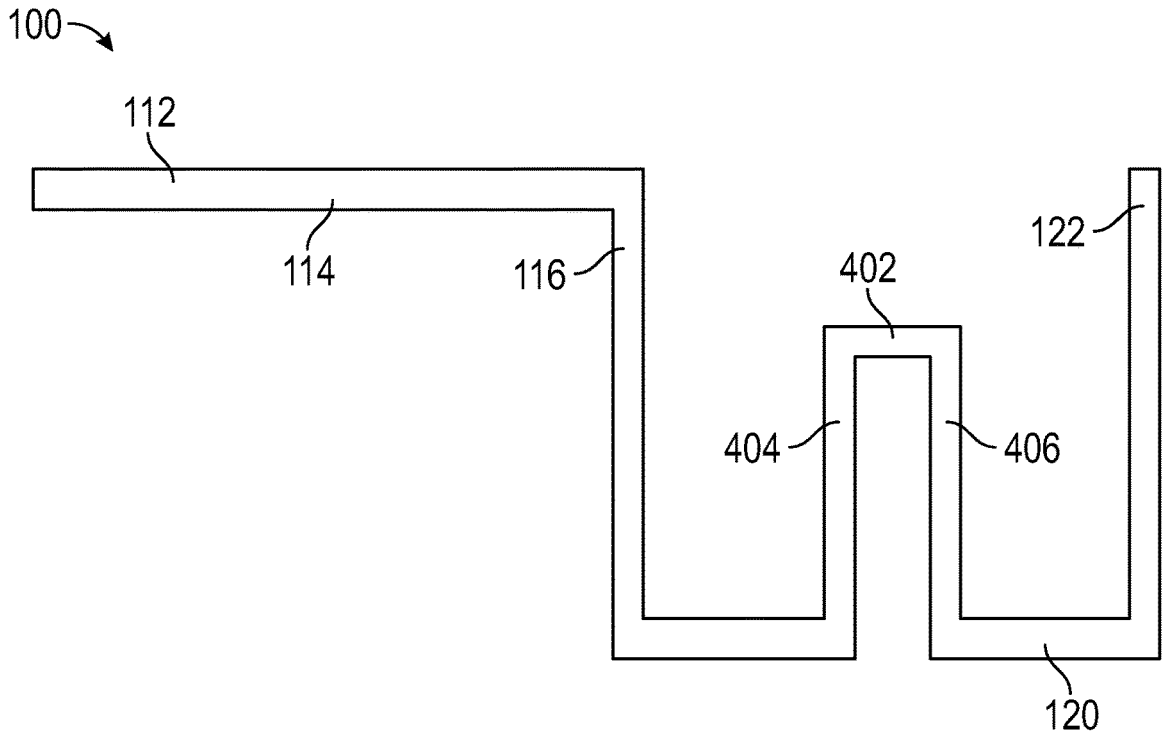
FIG. 4 provides a further alternative structure of the installation member.
Figure 5:
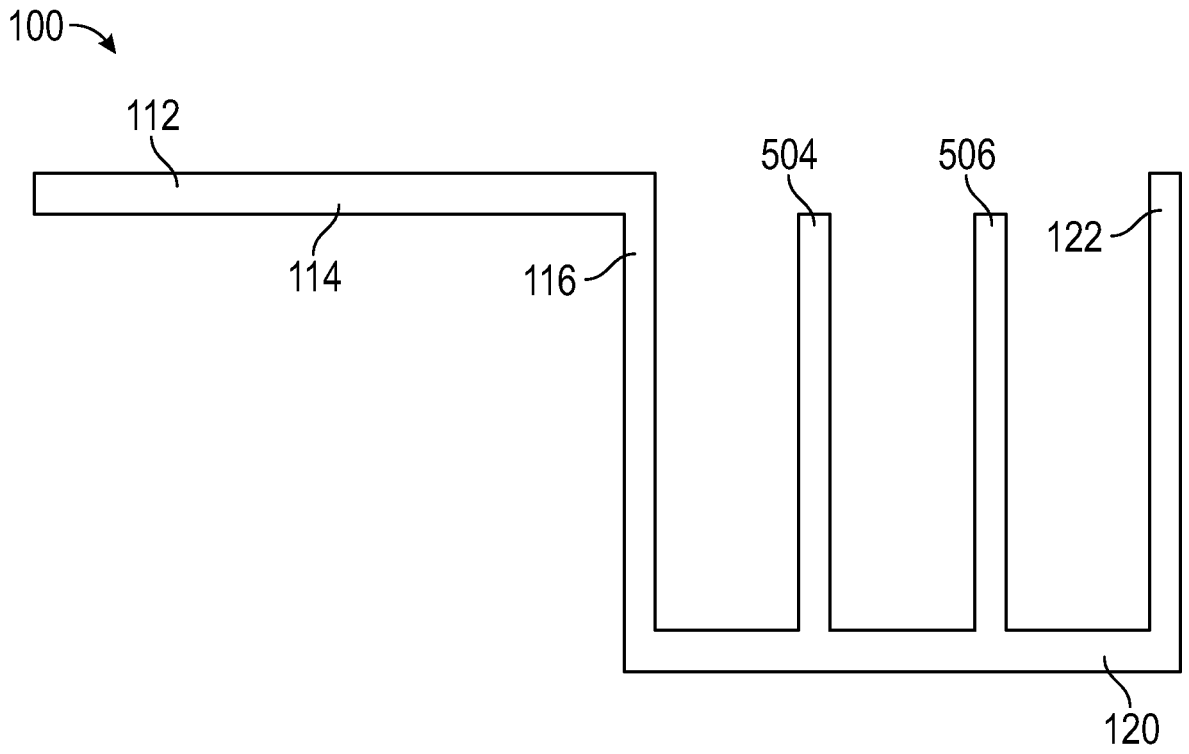
FIG. 5 provides a further alternative structure of the installation member.

The base member 128 is affixed to the installation member second horizontal element 120 at the second horizontal element interior surface 130 and positioned at a base member first end 158 adjacent the installation member first vertical element 116 at the first vertical element interior surface 132. The base member 128 may be constructed of a durable, resilient and stiff material to resist bending when installed. The base member 128 may be a metal, or a foam, or other material. However, materials which flex are desirable to accommodate movement of the substrates 202, 204 without fracturing. The base member 128 may be affixed to the installation member second horizontal element 120 by an adhesive, by a mechanical connection or any other system which binds the base member 128 to the installation member second horizontal element 120. Referring to FIG. 3, the installation member second horizontal element 120 need not be entirely horizontal and may include a wide secondary interior step 302 bounded by an installation member third vertical element 304 and an installation member fourth vertical element 306, each extending away from the installation member first horizontal element 114. The wide secondary interior step 302 may permit other materials to be included, such as further fire retardants or hydrophobic materials. Alternatively, as illustrated in FIG. 4, the installation member second horizontal element 120 may include a narrow secondary interior step 402, where the narrow secondary interior step 402 projects toward but not beyond the installation member first horizontal element 114 between the installation member first vertical element 116 and installation member second vertical element 122 by an alternative installation member third vertical element 404 and an alternative installation member fourth vertical element 406. When desired, the narrow secondary interior step 402 may serve as a central hanging support or as an attachment to a cover plate. In a further alternative, illustrated in FIG. 5, a further alternative installation member third vertical element 504 and a further alternative installation member fourth vertical element 506 may project toward, but not beyond, the installation member first horizontal element 114 from the installation member second horizontal element 120, where each of the further alternative installation member third vertical element 504 and a further alternative installation member fourth vertical element 506 may provide central support. When desired, the further alternative installation member third vertical element 504 and the further alternative installation member fourth vertical element 506 may serve as a central hanging support or as an attachment to a cover plate. The further alternative installation member third vertical element 504 and the further alternative installation member fourth vertical element 506 may support and/or separate and additional functional material from the other core materials, such as fire retardant or hydrophilic materials. The narrow secondary interior step 402 and the further alternative installation member third vertical element 504 and further alternative installation member fourth vertical element 506 may provide a spring or provide a spring force function to increase or change the expansion or recovery force of the foam or other expansion joint material.

To ensure connection to the first substrate 202, the installation member 112 may be adhesively bonded to the first substrate 202 by an adhesive 136, which may be an epoxy, applied to the installation member first vertical element exterior surface 134. The installation member first horizontal element 114 may likewise be adhesively bonded to the first substrate 202 by an adhesive, such as an epoxy.

To provide better anchorage for the installation member 112, the expansion joint seal system 100 may further include an installation member second vertical element 122 connected to the installation member second horizontal element 120. The installation member second vertical element 122 may be generally perpendicular, preferably 85-95 degrees though deviations of not more than +/−15 degrees may be acceptable, to the installation member second horizontal element 120 and at least partially adjacent the base member 128 at the base member second end 156. The installation member second vertical element 122 may be adjacent the base member 128 and may be bonded to it, such as by an adhesive or a mechanical attachment. The installation member second vertical element 122 may have an installation member second vertical element exterior surface 138 and an installation member second vertical element interior surface 140, such that the base member 128 may be adjacent and may be bonded to the installation member second vertical element interior surface 140. The installation member second vertical element interior surface 140 is intermediate the second vertical element exterior surface 138 and the installation member first end 124. The installation member second vertical element 122 may be fixedly connected to the installation member second horizontal element 120 and may be formed of the same material as the balance of the installation member 112. Other alternative constructions may be provided. Alternatively, the installation member second vertical element 122 may be a slidably connected version 224 connected to the installation member second horizontal element 120 in the first direction 126. When desired the installation member slidable second vertical element 224 may include its own installation member horizontal element, similar to the installation member first horizontal element 114. Such a slidable connection may be accomplished by including slots through the surface of one of the installation member second vertical element 122 and the installation member second horizontal element 120 or by providing an internal slot in the installation member second horizontal element 120 with an installation member second vertical element leg 228. The installation member second horizontal element 120 may be rigid, flexible or elastic and may be shaped to limit the contact and adhesion of the expansion joint seal (foam), which may avoid failure of the installation expansion joint seal 206 in response to longitudinal or transverse shear, such as by a concave shape or the use of a spacer 142.

To ensure connection to the second substrate 204, the installation member 112 may be adhesively bonded to the second substrate 204 by an adhesive 148, which may be an epoxy, applied to the installation member second vertical element exterior surface 138. When the installation member second vertical element 122 is fixedly connected to the installation member second horizontal element 120 it is compressed to have sufficient spring force to maintain contact with the second substrate 204 when gap width 220 of the gap 222 between the first substrate 202 and the second substrate 204 is at its maximum. When the installation member second vertical element 122 is slidably connected to the installation member second horizontal element 120, the installation member second vertical element 122 remains in position while it slides in relation to the installation member second horizontal element 120. The installation member second vertical element 122 and the installation member second horizontal element 120 and the expansion joint seal 206 may be configured to allow for cyclical, differential, transverse, longitudinal or other movement, such as by selection of materials tolerant of such conditions.

The expansion joint seal system 100 may be forced into contact with the first substrate 202 and 204 by the imposition of an expansion joint seal 206 between and in compression against the installation member first vertical element 116 at its installation member first vertical element interior surface 132 and against either the second substrate 204 or, where present, the installation member second vertical element 122 at its installation member second vertical element interior surface 140. The installation member first vertical element 116 may be shaped or profiled to increase the surface area for bonding to the substrate 202, 204, the base member 128 or the expansion joint seal 206, in whole or in part.

To control the relative position of the top of any expansion joint seal 206 in the installation member 112, it may be beneficial to position a spacer 142 atop the base member 128. The spacer 142 may be shaped to provide a profile to aid in retention of the expansion joint seal 206, such as by providing a concave shape to ensure any excessive compression results in the center of the expansion joint seal being forced upward. Alternatively, the spacer 142 may have a convex profile, or other profile, to allow for other functionality such as transfer loading or deflection. The shape and thickness of the spacer 142 may be adjusted in response to the expansion joint seal 206 selected for use. When the spacer is greater than the minimum intended size of the joint, the spacer 142 may be composed of a resiliently compressible and may provide a further spring force to resist compression. The spacer 142 may further be constructed to provide other functional benefits, including spring force, resistance to air or sound penetration and to provide water resistance and/or fire resistance.

The expansion joint seal 206 may be of any type now known in the art or developed hereafter as an expansion joint seal. Referring to FIG. 2, in one embodiment, the expansion joint seal 206 may comprise a set of separate, independent water-resistant and fire resistant layers, as has been well known in the art since at least 2007. The expansion joint seal 206 may comprise a water retarding layer 210 of a durable, water-resistant foam extending from the installation member first vertical element interior surface 132 and the second vertical element interior surface 140. The water retarding layer 210 may be the water retarding layer 210 may be a gland with a foam core. Because backpressure from the water retarding layer 210 is not necessary to ensure a bond of the expansion joint seal system 100 to the substrates 202, 204, the water retarding layer 210 may be selected to have a low density after installation, where low density means not exceeding 175 kg/m$^3$, or may selected to have a high density after installation, where high density means not less than 725 kg/m$^3$. The water retarding layer 210 may contain a fire retarding component and may extend from the installation member first vertical element interior surface 132 to the second vertical element interior surface 140, but may be selected to include the fire retarding component in an amount insufficient for the layer to independently satisfy known fire resistance standards, such as DIN 4102, UL 2079, UL 94 ASTM E-119, and E-84.

The fire retarding layer 208 may be selected to have a low density after installation, where low density means not exceeding 175 kg/m$^3$, or may selected to have a high density after installation, where high density means not less than 725 kg/m$^3$. When desired, other densities above or below the range may be selected.

The fire retarding layer 208 may contain a fire retarding component in an amount sufficient for the layer to independently satisfy known fire resistance standards, such as DIN 4102, UL 2079, UL 94 ASTM E-119, and E-84 depending on the product parameter and intended use elected. The fire retarding layer 208 extends from the installation member first vertical element interior surface 132 to the second vertical element interior surface 140 and may contact one of the base member 128 and the installation member first vertical element interior surface 132.

When desired, the water-retarding layer 210 may contact or may be spaced apart from a fire retarding layer 208, such as by the form of installation chosen or by use of an expansion joint seal spacer 212. The expansion joint seal spacer 212 may likewise be shaped, such as with a concave shape. The expansion joint spacer 212 may alternatively be composed of more than one spacer, piece or layer, may be intermittently placed, may fill less than the intended gap width 220, may be rigid, semi-flexible or flexible, a combination thereof or may be a composite.

When further functional characteristics are desired, a secondary layer 144, having a secondary layer height 160, may be applied, adhered, attached or bonded to the installation member second horizontal element 120 at its installation member second horizontal element exterior surface 146. The secondary layer 144 may provide an additional spring force, such as by use of a higher density foam, or may provide a hydrophobic or hydrophilic material when desired, or may be a fire retardant material, such as a foam containing a fire retardant or may be an intumescent material. The secondary layer 144 may be selected to provide multiple benefits. The secondary layer 144 may be a sound-insulating foam, a water-resistant foam, or a foam containing a fire retarding component. Conversely, the secondary layer 144 may be selected to provide less than all properties desired in a fire- and water-resistant expansion joint system, such as lacking water resistance, or a particular degree of fire resistance, or wind resistance, or a particular density range. The installation member first vertical element height 118 is sized to ensure the expansion joint seal system 100, whether the secondary layer 144 is included, is fully retained within the gap 222 and therefore the sum of the installation member first vertical element height 118 and the secondary layer height 160 is not greater than the gap depth 108.

Any of the foregoing materials may be composed of or coating with a self-repairing material which will seal against any puncture.

With regard to the water retarding layer 210, when composed of a foam it may be closed cell or open cell foam, or a combination thereof, which may be foamed in place, in whole or in part. The extent of compressibility may be selected based on the need. A higher compression is known to result in higher water resistance, but may create difficulties in installation, and ultimately becomes so compressed as to lack flexibility or further compressibility, such as at a ratio of 5:1. The water retarding layer 210 may be compressible by 25%, or may compress by 100% or as high as 400%. However, the higher compression ratios negatively affect the functionality of the expansion joint seal 206 by, among other issues, reducing the movement of the expansion joint seal 206 within the gap 222. As the gap width 220 cycles, the actual compression ratio will change, so the optimum ratio should be selected. A 2:1 compression ratio may be used, but preferably not greater than 4:1. Lower compression ratios are desirable, as these allow a full +/−50% movement, and potentially even /−100%, versus the −25%/+35% movement typical of products in the art. While the water retarding layer 210 may be composed of a single piece of foam, the water retarding layer 210 may be formed by horizontal, vertical or diagonal lamination of foam members to one another or any other combination or orientation.

Moreover, the water retarding layer 210 may be selected from partially closed cell or viscoelastic foams. Most prior art foams seals have been designed as "soft foam" pre-compressed foam seals utilizing low to medium density foam (about 16-30 kg/m$^3$) and softer foam (ILD range of about 10-20). It has been surprisingly found through extensive testing of variations of foam densities and foam hardness, fillers and elastic impregnation compounds that higher density "hard" foams with high ILD's can provide an effective water retarding layer 210 meeting the required waterproofing (for driving rain 600 Pa minimum and ideally 1000 Pa or greater) or standing water and movement and cycling requirements such as ASTM E-1399 Standard Test Method for Cyclic Movement and Measuring the Minimum and Maximum Joint Widths of Architectural Joint Systems as well as long term joint cycling and movement ranges greater than provided for in this test standard. An advantage has been found in using higher density and higher hardness (higher ILD) foams particularly in horizontal applications. While at first this might seem obvious it is known in the art that higher density foams that are about 32-50 kg/m$^3$ with an ILD rating of about 40 and greater tend to have other undesirable properties such as a long term decrease in fatigue resistance. Desirable properties such as elongation, ability to resist compression set, foam resiliency and fatigue resistance typically decline relative to an increase in density and ILD. These undesirable characteristics are often more pronounced when fillers such as calcium carbonate, nano fillers, clay, hollow spheres, melamine and others are utilized to increase the foam density yet the cost advantage of the filled foam is beneficial and desirable. Similarly, when graft polyols are used in the manufacture of the base foam to increase the hardness or load carrying capabilities, other desirable characteristics of the base foam such as resiliency and resistance to compression set can be diminished. Through the testing of non-conventional impregnation binders, coatings and elastomers for pre-compressed foam sealants such as silicones, urethanes, polyureas, epoxies, and the like, it has been found that materials that have reduced tack or adhesive properties after cure and which provide a high internal recovery force can be used to counteract the long term fatigue resistance of the high density, high ILD foams. Further, it has been found that by first coating but not filling the foams cell structure with silicone, acrylic, urethane, epoxies or other low tack polymers and, ideally, elastomers with about 25% tensile elongation or greater providing a sufficient internal recovery force, that it may be additionally advantageous to then impregnate or put material into the foam such as another elastomer, binder or fillers to provide a timed expansion recovery at specific temperatures. The coating materials with higher long term recovery capabilities imparted to the cell structure of the high density, high ILD base foams, such as a silicone or urethane elastomers, can additionally be used to impart color to the water retarding layer 210 or be a clear or translucent color to retain the base foam color. Where color is intended as an identifier of associated properties, it may be advantageous to coat the foam, rather than impregnate, infuse, or put the colored materials into the foam as such colored material may be pushed or bleed out under high pressure or heat. Providing for the color or other function as a part of the foam or coated foam itself reduces the likelihood of a highly visible or colored material from transferring to the surface or substrate. If desirable one or more traditional steps of impregnation, partial impregnation, putting into or coating can be applied to or into the water retarding layer 210 to add additional functional characteristics such as UV stability, mold and mildew resistance, color, fire-resistance or fire-ratings or other properties deemed desirable to functionality to the foam.

Viscoelastic foams have not typically been commercially available or used for water-resistant seals due to perceived shortcomings. Commonly used formulations, ratios and methods do not provide a commercially viable water retarding layer 210 using viscoelastic foam when compared to standard polyurethane foams. Open cell viscoelastic foams are more expensive than polyester or polyether polyurethane foams commonly used in water-resistant seals. Any impregnation process on a viscoelastic foam tends to proceed slower than on a traditional foam due to the fine cell structure and partially closed cells of viscoelastic foam. This can be particularly frustrating as the impregnation materials and the impregnation process are typically the most expensive component of a water-resistant seal. However, because of their higher initial density viscoelastic foams can provide better load carrying or pressure resistant water-resistant seal. Both properties are desirable but not fully provided for in the current art for use in applications such as load carrying horizontal joints or expansion joints for secondary containment. Common densities found in viscoelastic foams are 64-80 kg/m$^3$ while densities outside this range are available. Additionally, viscoelastic foams have four functional properties (density, ILD rating, temperature and time) compared to flexible polyurethane foams, which have two primary properties (density and an ILD rating).

However, the speed of recovery of viscoelastic foams following compression may be increased by reducing or eliminating any impregnation, surface impregnation or low adhesive strength impregnation compound. Likewise, incorporating fillers into the impregnation compound is known to be effective in controlling the adhesive strength of the impregnation binder and therefore the re-expansion rate of the impregnated foam. By surface impregnating or coating the outside surface of one or more sides of viscoelastic foam to approximately 10% of the foam thickness, such as about 3-8 mm deep for conventional joint seals, the release time can be controlled and predicted based on ambient temperature. Additional surface coating may be used but with a diminishing return. Alternatively, the foam can be infused, partially impregnated or impregnated with a functional or non-functional filler without a using binder but rather only a solvent or water as the impregnation carrier where the carrier evaporates leaving only the filler in the foam.

The re-expansion rate of any water-resistant seal, including those using viscoelastic foam, may be altered by using un-impregnated viscoelastic foam strips laminated or adhered with a pressure sensitive adhesive or hot melt adhesive. When the water-resistant seal is compressed, the laminating adhesive serves as a temporary restriction to re-expansion allowing time to install the water-resistant seal. Viscoelastic foam may be advantageously used, rather than standard polyurethane foam, for joints requiring additional softness and flexibility due to higher foam compression in hot climates or exposure or increased stiffness in cold temperatures when a foam is at its minimum compressed density. Additionally, closed cell, partially closed cell and other foams can be used as in combination with the viscoelastic foams to reduce the overall cost or improve function.

Additionally, when desired, an elastomeric coating 230 may be adhered to the water retarding layer. The elastomeric coating 106 may be any desirable material, such as silicone or urethane, and may have characteristics selected for the particular use, such as being fire-rated. The elastomer coating 230 may therefore also contain an intumescent. The elastomeric coating 230 may be applied in strips or as a continuous coating. The elastomeric coating 230 provides the traffic contact point when the expansion joint seal system 100 having an expansion joint seal 206 is installed in a gap 222. Alternatively, a rigid or non-elastomer may be applied in an intermittent or non-continuous manner directly to the foam seal or to an elastomer coating.

Installation and maintenance of the expansion joint seal system 100 is enabled by its construction. Because the water-resistant layer 210 is separate from the fire retarding layer 208, the water-resistant layer 210, which is exposed to surface wear and tear, may be independently removed for replacement, which facilitates the opportunity to visually inspect—and replace as needed—the fire retarding layer 208. To aid in installation, the water retarding layer 210 and/or the fire retarding layer 208 may include an elongated beveled surface. To increase the water retarding property of water retarding layer 210, an adhesive coating may be applied to its sides. When desired, an expansion joint seal system 100 may be compressed, in whole or in part, prior to leaving the manufacturing facility. The expansion joint seal system 100 may be supplied in continuous lengths, including transitions, eliminating the need for splices or joints.

When further fire retardancy is desired, further elements may be incorporated into the expansion joint seal 206, such as a graphite-based fire-retardant material or an intumescent. Other functional attributes may be altered by inclusion of other materials in either of the water retarding layer 210 and/or the fire retarding layer 208, such as voids or springs to aid in recovery, and by addition of hydrophilic elements, shaped as beads or rods, which may be imposed or may be formed in situ. A hydrophilic rod, for example, may be selected to provide additional water resistance.

The water retarding layer 210 and the fire retarding layer 208 may be treated with fire retardant additives, by methods known in the art, such as infusion, impregnation and coating. Adhesives 134, 148 and elastomeric coating 230 may likewise be selected to provide fire retardancy characteristics. The expansion joint seal system 100 may be coated or sprayed during manufacturing or in situ with a fire resistant coating, preferably elastomeric, such as manufactured by 3M, Hilti or W.R.Grace. When coated during manufacturing it is preferable to apply the coating when the foam core is expanded at least 10% greater than the maximum intended joint or gap width.

Additionally, when desired, a sensor 232 may be included and may contact one of more of the components of the expansion joint seal system 100. The sensor 232 may be a radio frequency identification device (RFID) or other wirelessly transmitting sensor. A sensor may be beneficial to assess the health of an expansion joint seal system 100 without accessing the interior or underside of the expansion joint seal 206. Such sensors are known in the art, and which may provide identification of circumstances such as moisture penetration and accumulation. The inclusion of a sensor 232 in the expansion joint seal system 100 may be particularly advantageous in circumstances where the expansion joint seal system 100 is concealed after installation, particularly as moisture sources and penetration may not be visually detected. Thus, by including a low cost, moisture-activated or sensitive sensor, the user can scan the expansion joint seal system 100 for any points of weakness due to water penetration. A heat sensitive sensor 232 may also be positioned within the expansion joint seal 206, thus permitting identification of actual internal temperature, or identification of temperature conditions requiring attention, such as increased temperature due to the presence of fire, external to the joint or even behind it, such as within a wall. Such data may be particularly beneficial in roof and below grade installations where water penetration is to be detected as soon as possible.

Inclusion of a sensor 232 in the expansion joint seal system 100 may provide substantial benefit for information feedback and potentially activating alarms or other functions within the expansion joint seal system 100 or external systems. Fires that start in curtain walls are catastrophic. High and low-pressure changes have deleterious effects on the long-term structure and the connecting features. Providing real time feedback and potential for data collection from sensors 232, particularly given the inexpensive cost of such sensors 232, in those areas and particularly where the wind, rain and pressure will have their greatest impact would provide benefit. While the pressure on the wall is difficult to measure, for example, the deflection in a pre-compressed sealant is quite rapid and linear. Additionally, joint seals are used in interior structures including but not limited to bio-safety and cleanrooms. Additionally, a sensor 232 could be selected which would provide details pertinent to the state of the Leadership in Energy and Environmental Design (LEED) efficiency of the building. Additionally, such a sensor 232, which could identify and transmit air pressure differential data, could be used in connection with masonry wall designs that have cavity walls or in the curtain wall application, where the air pressure differential inside the cavity wall or behind the cavity wall is critical to maintaining the function of the system. A sensor 232 may be positioned in other locations within the expansion joint seal 100 to provide beneficial data. A sensor 232 may be positioned to provide prompt notice of detection of heat outside typical operating parameters, so as to indicate potential fire or safety issues. Such a positioning would be advantageous in horizontal of confined areas. A sensor 232 so positioned might alternatively be selected to provide moisture penetration data, beneficial in cases of failure or conditions beyond design parameters. The sensor 232 may provide data on moisture content, heat or temperature, moisture penetration, and manufacturing details. A 232 sensor may provide notice of exposure from the surface of the expansion joint seal system 100 most distant from the base of the joint. A sensor 232 may further provide real time data. Using a moisture sensitive sensor 232 in the expansion joint seal system 100 and at critical junctions/connections would allow for active feedback on the waterproofing performance of the expansion joint seal system 100. It can also allow for routine verification of the watertightness with a hand-held sensor reader to find leaks before the reach occupied space and to find the source of an existing leak. Often water appears in a location much different than it originates making it difficult to isolate the area causing the leak. A positive reading from the sensor 232 alerts the property owner to the exact location(s) that have water penetration without or before destructive means of finding the source. The use of a sensor 232 in the expansion joint seal 100 is not limited to identifying water intrusion but also fire, heat loss, air loss, break in joint continuity and other functions that cannot be checked by non-destructive means. Use of a sensor 232 within expansion joint seal 100 may provide a benefit over the prior art. Impregnated foam materials, which may be used for the expansion joint seal 100, are known to cure fastest at exposed surfaces, encapsulating moisture remaining inside the body, and creating difficulties in permitting the removal of moisture from within the body. While heating is a known method to addressing these differences in the natural rate of cooling, it unfortunately may cause degradation of the foam in response. Similarly, while forcing air through the foam bodies may be used to address the curing issues, the potential random cell size and structure impedes airflow and impedes predictable results. Addressing the variation in curing is desirable as variations affect quality and performance properties. The use of a sensor 232 within expansion joint seal 100 may permit use of the heating method while minimizing negative effects. The data from the sensors 232, such as real-time feedback from the heat, moisture and air pressure sensors, aids in production of a consistent product. Moisture and heat sensitive sensors 232 aid in determining and/or maintaining optimal impregnation densities, airflow properties of the foam during the curing cycle of the foam impregnation. Placement of the sensors 232 into one of the water retarding layer 210 and the fire retarding layer 208 of expansion joint seal system 100 at the pre-determined different levels allows for optimum curing allowing for real time changes to temperature, speed and airflow resulting in increased production rates, product quality and traceability of the input variables to that are used to accommodate environmental and raw material changes for each product lots.

The selection of components providing resiliency, compressibility, water-resistance and fire resistance, the expansion joint seal system 100 may be constructed to provide sufficient characteristics to obtain fire certification under any of the many standards available. In the United States, these include ASTM International's E 814 and its parallel Underwriter Laboratories UL 1479 "Fire Tests of Through-penetration Firestops," ASTM International's E1966 and its parallel Underwriter Laboratories UL 2079 "Tests for Fire-Resistance Joint Systems," ASTM International's E 2307 "Standard Test Method for Determining Fire Resistance of Perimeter Fire Barrier Systems Using Intermediate-Scale, Multi-story Test Apparatus, the tests known as ASTM E 84, UL 723 and NFPA 255 "Surface Burning Characteristics of Building Materials," ASTM E 90 "Standard Practice for Use of Sealants in Acoustical Applications," ASTM E 119 and its parallel UL 263 "Fire Tests of Building Construction and Materials," ASTM E 136 "Behavior of Materials in a Vertical Tube Furnace at 750° C." (Combustibility), ASTM E 1399 "Tests for Cyclic Movement of Joints," ASTM E 595 "Tests for Outgassing in a Vacuum Environment," ASTM G 21 "Determining Resistance of Synthetic Polymeric Materials to Fungi." Some of these test standards are used in particular applications where firestop is to be installed.

Most of these use the Cellulosic time/temperature curve, described by the known equation T=20+345*LOG (8*t+1) where t is time, in minutes, and T is temperature in degrees Celsius including E 814/UL 1479 and E 1966/UL 2079.

E 814/UL 1479 tests a fire-retardant system for fire exposure, temperature change, and resilience and structural integrity after fire exposure (the latter is generally identified as "the Hose Stream test"). Fire exposure, resulting in an F [Time] rating, identifies the time duration—rounded down to the last completed hour, along the Cellulosic curve before flame penetrates through the body of the system, provided the system also passes the hose stream test. Common F ratings include 1, 2, 3 and 4 hours Temperature change, resulting in a T [Time] rating, identifies the time for the temperature of the unexposed surface of the system, or any penetrating object, to rise 181° C. above its initial temperature, as measured at the beginning of the test. The rating is intended to represent how long it will take before a combustible item on the non-fireside will catch on fire from heat transfer. In order for a system to obtain a UL 1479 listing, it must pass both the fire endurance (F rating) and the Hose Stream test. The temperature data is only relevant where building codes require the T to equal the F-rating. In the present expansion joint seal system 100, the bottom surface temperature at a maximum joint width increases no more than 181° C. after sixty minutes when the expansion joint seal system 100 is exposed to heating according to the equation T=20+345*LOG (8*t+1), where t is time in minutes and T is temperature in C. Further, where the expansion joint seal system has a maximum joint width of more than six (6) inches, the bottom surface temperature increases no more than 139° C. after sixty minutes when the expansion joint seal system 100 is exposed to heating according to the equation T=20+345*LOG (8*t+1), where t is time in minutes and T is temperature in C.

When required, the Hose Steam test is performed after the fire exposure test is completed. In some tests, such as UL 2079, the Hose Stream test is required with wall-to-wall and head-of-wall joints, but not others. This test assesses structural stability following fire exposure as fire exposure may affect air pressure and debris striking the fire-resistant system. The Hose Stream uses a stream of water. The stream is to be delivered through a 64 mm hose and discharged through a National Standard playpipe of corresponding size equipped with a 29 mm discharge tip of the standard-taper, smooth-bore pattern without a shoulder at the orifice consistent with a fixed set of requirements:

| Hourly Fire Rating Time in Minutes | Water Pressure (kPa) | Duration of Hose Stream Test (sec./m$^2$) |
|---|---|---|
| 240 ≤ time < 480 | 310 | 32 |
| 120 ≤ time < 240 | 210 | 16 |
| 90 ≤ time < 120 | 210 | 9.7 |
| time < 90 | 210 | 6.5 |

The nozzle orifice is to be 6.1 m from the center of the exposed surface of the joint system if the nozzle is so located that, when directed at the center, its axis is normal to the surface of the joint system. If the nozzle is unable to be so located, it shall be on a line deviating not more than 30° from the line normal to the center of the joint system. When so located its distance from the center of the joint system is to be less than 6.1 m by an amount equal to 305 mm for each 10° of deviation from the normal. Some test systems, including UL 1479 and UL 2079 also provide for air leakage and water leakage tests, where the rating is made in conjunction with a L and W standard. These further ratings, while optional, are intended to better identify the performance of the system under fire conditions. The expansion joint seal system 100 may be constructed to successfully complete this Hose Steam test, where there is no penetration of water through the expansion joint seal system 100.

When desired, the Air Leakage Test, which produces an L rating and which represents the measure of air leakage through a system prior to fire endurance testing, may be conducted. The L rating is not pass/fail, but rather merely a system property. For Leakage Rating test, air movement through the system at ambient temperature is measured. A second measurement is made after the air temperature in the chamber is increased so that it reaches 177° C. within 15 minutes and 204° C. within 30 minutes. When stabilized at the prescribed air temperature of 204±5° C., the air flow through the air flow metering system and the test pressure difference are to be measured and recorded. The barometric pressure, temperature and relative humidity of the supply air are also measured and recorded. The air supply flow values are corrected to standard temperature and pressure (STP) conditions for calculation and reporting purposes. The air leakage through the joint system at each temperature exposure is then expressed as the difference between the total metered air flow and the extraneous chamber leakage. The air leakage rate through the joint system is the quotient of the air leakage divided by the overall length of the joint system in the test assembly and is less than 0.005 $L/s \cdot m^2$ at 75 Pa or equivalent air flow extraneous, ambient and elevated temperature leakage tests. The expansion joint seal system 100 may be constructed to successfully achieve an L rating.

When desired, the Water Leakage Test produces a W pass-fail rating and which represents an assessment of the watertightness of the system, can be conducted. The test chamber for or the test consists of a well-sealed vessel sufficient to maintain pressure with one open side against which the system is sealed and wherein water can be placed in the container. Since the system will be placed in the test container, its width must be equal to or greater than the exposed length of the system. For the test, the test fixture is within a range of 10 to 32° C. and chamber is sealed to the test sample. Non-hardening mastic compounds, pressure-sensitive tape or rubber gaskets with clamping devices may be used to seal the water leakage test chamber to the test assembly. Thereafter, water, with a permanent dye, is placed in the water leakage test chamber sufficient to cover the systems to a minimum depth of 152 mm. The top of the joint system is sealed by whatever means necessary when the top of the joint system is immersed under water and to prevent passage of water into the joint system. The minimum pressure within the water leakage test chamber shall be 1.3 psi applied for a minimum of 72 hours. The pressure head is measured at the horizontal plane at the top of the water seal. When the test method requires a pressure head greater than that provided by the water inside the water leakage test chamber, the water leakage test chamber is pressurized using pneumatic or hydrostatic pressure. Below the system, a white indicating medium is placed immediately below the system. The leakage of water through the system is denoted by the presence of water or dye on the indicating media or on the underside of the test sample. The system passes if the dyed water does not contact the white medium or the underside of the system during the 72 hour assessment. The expansion joint seal system 100 may be constructed to successfully achieve an W rating.

Another frequently encountered classification is ASTM E-84 (also found as UL 723 and NFPA 255), Surface Burning Characteristics of Burning Materials. A surface burn test identifies the flame spread and smoke development within the classification system. The lower a rating classification, the better fire protection afforded by the system. These classifications are determined as follows:

| Classification | Flame Spread | Smoke Development |
|---|---|---|
| A | 0-25 | 0-450 |
| B | 26-75 | 0-450 |
| C | 76-200 | 0-450 |

UL 2079, Tests for Fire Resistant of Building Joint Systems, comprises a series of tests for assessment for fire resistive building joint system that do not contain other unprotected openings, such as windows and incorporates four different cycling test standards, a fire endurance test for the system, the Hose Stream test for certain systems and the optional air leakage and water leakage tests. This standard is used to evaluate floor-to-floor, floor-to-wall, wall-to-wall and top-of-wall (head-of-wall) joints for fire-rated construction. As with ASTM E-814, UL 2079 and E-1966 provide, in connection with the fire endurance tests, use of the Cellulosic Curve. UL 2079/E-1966 provides for a rating to the assembly, rather than the convention F and T ratings. Before being subject to the Fire Endurance Test, the same as provided above, the system is subjected to its intended range of movement, which may be none. These classifications are:

| Movement Classification (if used) | Minimum number of cycles | Minimum cycling rate (cycles per minute) | Joint Type (if used) |
|---|---|---|---|
| No Classification | 0 | 0 | Static |
| Class I | 500 | 1 | Thermal Expansion/Contraction |
| Class II | 500 | 10 | Wind Sway |
| Class III | 100 | 30 | Seismic |
| | 400 | 10 | Combination |

Preferably, the expansion joint seal system 100 can be cycled at least one of more of 500 times at 1 cycle per minute, 500 times at 10 cycles per minute and 100 cycles at 30 times per minute, without indication of stress, deformation or fatigue.

ASTM E 2307, Standard Test Method for Determining Fire Resistance of Perimeter Fire Barrier Systems Using Intermediate-Scale, Multi-story Test Apparatus, is intended to test for a systems ability to impede vertical spread of fire from a floor of origin to that above through the perimeter joint, the joint installed between the exterior wall assembly and the floor assembly. A two-story test structure is used wherein the perimeter joint and wall assembly are exposed to an interior compartment fire and a flame plume from an exterior burner. Test results are generated in F-rating and T-rating. Cycling of the joint may be tested prior to the fire endurance test and an Air Leakage test may also be incorporated. The expansion joint seal system 100 may be constructed to successfully ASTM E 2307.

As can be appreciated, the foregoing disclosure may incorporate other expansion joint seals, such as those with fire retardant members in a side adjacent the substrate, the inclusion of a separate barrier which may extend beyond the expansion joint seal 206 or remain encapsulated within, one or more longitudinal load transfer members atop or the water retarding layer 210, without or without support members, a cover plate, a spline or ribs tied to the cover plate whether fixedly or detachably, use of auxetic materials, or constructed to obtain a fire endurance rating or approval according to any of the tests known in the United States and Europe for use with expansion joint seals, including fire endurance, movement classification(s), load bearing capacity, air penetration and water penetration. The foregoing disclosure and description is illustrative and explanatory thereof. Various changes in the details of the illustrated construction may be made within the scope of the appended claims without departing from the spirit of the invention. The present invention should only be limited by the following claims and their legal equivalents.

I claim:

1. An expansion joint seal system for imposition between a first substrate and a second substrate, the expansion joint seal system comprising:

an installation member, the installation member being flexible and resilient, the installation member having an installation member first end, the installation member having an installation member first horizontal element extending from the installation member first end in a first direction, the installation member having an installation member first vertical element the installation member first horizontal element connected to the installation member first vertical element, the installation member first horizontal element being generally perpendicular to the installation member first vertical element, the installation member first vertical element having an installation member first vertical element exterior surface and a first vertical element interior surface, the installation member first vertical element exterior surface intermediate the first vertical element interior surface and the installation member first end, the installation member having an installation member second horizontal element connected to the installation member first vertical element, the installation member second horizontal element being generally perpendicular to the installation member first vertical element, the installation member second horizontal element extending from the installation member first vertical element in the first direction, the installation member second horizontal element having a second horizontal element interior surface and an installation member second horizontal element exterior surface;

a base member, the base member affixed to the installation member second horizontal element at the second horizontal element interior surface and positioned adjacent the installation member first vertical element at the first vertical element interior surface; and an installation member second vertical element being generally perpendicular to the installation member second horizontal element, the installation member second vertical element having an installation member second vertical element exterior surface and an installation member second vertical element interior surface, the installation member second vertical element interior surface intermediate the second vertical element exterior surface and the installation member first end, and the installation member second vertical element fixedly connected to the installation member second horizontal element.

2. The expansion joint seal system of claim 1, further comprising an adhesive applied to the installation member first vertical element exterior surface.

3. The expansion joint seal system of claim 1, further comprising an adhesive applied to the second vertical element exterior surface.

4. The expansion joint seal system of claim 1, wherein the installation member second vertical element is slideably connected to the installation member second horizontal element in the first direction.

5. The expansion joint seal system of claim 1, further including a spacer positioned adjacent the base member.

6. The expansion joint seal system of claim 5, wherein the spacer is resiliently compressible.

7. The expansion joint seal system of claim 1, further comprising a secondary layer applied to an installation member second horizontal element exterior surface.

8. The expansion joint seal system of claim 1, further comprising an expansion joint seal positioned intermediate the installation member first vertical element interior surface and the second vertical element interior surface.

9. The expansion joint seal system of claim 8, wherein the expansion joint seal comprises:

a water retarding layer of durable, high density, water-resistant foam extending from the installation member first vertical element interior surface and the second vertical element interior surface; and a fire retarding layer of low density foam containing a fire retarding component extending from the installation member first vertical element interior surface and the second vertical element interior surface, and contacting one of the base member and the installation member first vertical element interior surface.

10. The expansion joint seal system of claim 9, wherein the layer of durable, high density, water-resistant foam is separated from the layer of low density foam containing a fire retarding component.

11. The expansion joint seal system of claim 10, wherein the layer of durable, high density, water-resistant foam is separated from the layer of low density foam containing a fire retarding component by an expansion joint seal spacer.

12. The expansion joint seal system of claim 7, wherein the secondary layer is one of the group comprising a sound-insulating foam, a water-resistant foam, and a foam containing a fire retarding component.

13. The expansion joint seal system of claim 1, wherein the first substrate and the second substrate are separated by a gap having a gap depth and a gap width and wherein the installation member first vertical element has an installation member first vertical element height, the gap depth greater than an installation member first vertical element height.

* * * * *